US011670276B2

(12) United States Patent
Kim

(10) Patent No.: US 11,670,276 B2
(45) Date of Patent: Jun. 6, 2023

(54) HIGH-FREQUENCY BROADBAND AIRBORNE NOISE ACTIVE NOISE CANCELLATION

(71) Applicant: HARMAN INTERNATIONAL INDUSTRIES, INCORPORATED, Stamford, CT (US)

(72) Inventor: Geon-Seok Kim, Novi, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 30 days.

(21) Appl. No.: 17/420,111

(22) PCT Filed: Jan. 3, 2020

(86) PCT No.: PCT/US2020/012185
§ 371 (c)(1),
(2) Date: Jun. 30, 2021

(87) PCT Pub. No.: WO2020/142690
PCT Pub. Date: Jul. 9, 2020

(65) Prior Publication Data

US 2022/0059069 A1 Feb. 24, 2022

Related U.S. Application Data

(60) Provisional application No. 62/788,413, filed on Jan. 4, 2019.

(51) Int. Cl.
*G10K 11/178* (2006.01)
*H04R 1/04* (2006.01)
(Continued)

(52) U.S. Cl.
CPC ..... *G10K 11/17825* (2018.01); *H04R 1/04* (2013.01); *H04R 1/08* (2013.01);
(Continued)

(58) Field of Classification Search
CPC ... G10K 11/17825; G10K 2210/12821; G10K 2210/3226; H04R 1/04; H04R 1/08; H04R 1/222; H04R 2201/003
(Continued)

(56) References Cited

U.S. PATENT DOCUMENTS 5,117,401 A * 5/1992 Feintuch ..... G10K 11/17817 367/901
2016/0221581 A1 8/2016 Talwar et al.

FOREIGN PATENT DOCUMENTS

JP H04342296 A 11/1992
WO 2008029336 A1 3/2008

OTHER PUBLICATIONS

Shust, Electronic Removal of Outdoor Microphone Wind Noise, Acoustical Society of America, 136th Meeting Lay Language Papers, Oct. 13, 1998.

* cited by examiner

*Primary Examiner* — Vivian C Chin
*Assistant Examiner* — Douglas J Suthers
(74) *Attorney, Agent, or Firm* — Brooks Kushman P.C.

(57) ABSTRACT

Noise signals are captured from one or more physical error microphones located at first locations within the vehicle. High-frequency noise signals are captured from a feedforward system sensor. A virtual microphone algorithm is utilized to estimate noise signals at a virtual location based on the noise signals, the estimation utilizing a transfer function that estimates a signal that would have been received by the one or more physical error microphones at the virtual location. The virtual microphone algorithm is utilized to estimate noise signals at the virtual location based on the high-frequency noise signal. A noise-cancelling signal is provided to cancel noise at the virtual location, the noise-cancelling signal accounting for the noise captured by
(Continued)

both the feedforward system sensor and the one or more physical error microphones, the ANC system utilizing a working frequency for the ANC of at least 2 kHz.

18 Claims, 16 Drawing Sheets

(51) Int. Cl.
*H04R 1/08* (2006.01)
*H04R 1/22* (2006.01)

(52) U.S. Cl.
CPC ..... *G10K 2210/12821* (2013.01); *G10K 2210/3226* (2013.01); *H04R 1/222* (2013.01); *H04R 2201/003* (2013.01)

(58) Field of Classification Search
USPC ..... 381/71.4
See application file for complete search history.

200

200

400

Inside Microphone

Flush Mount Microphone

800

900

900

900

HIGH-FREQUENCY BROADBAND AIRBORNE NOISE ACTIVE NOISE CANCELLATION

CROSS-REFERENCE TO RELATED APPLICATION

This application is the U.S. national phase of PCT Application No. PCT/US2020/012185 filed on Jan. 3, 2020, which claims the benefit of U.S. provisional application Ser. No. 62/788,413, filed on Jan. 4, 2019, the disclosures of which are hereby incorporated in its entirety by reference herein.

TECHNICAL FIELD

Aspects of the disclosure generally relate to active noise cancellation for high-frequency broadband airborne noise.

BACKGROUND

Active noise cancellation (ANC) may be used to generate sound waves or anti-noise that destructively interferes with undesired sound waves. The destructively-interfering sound waves may be produced through a loudspeaker to combine with the undesired sound waves in an attempt to cancel the undesired noise. Combination of the destructively interfering sound waves and the undesired sound waves can eliminate or minimize perception of the undesired sound waves by one or more listeners within a listening space.

SUMMARY

In one or more illustrative examples, a system for active noise cancellation (ANC) of high-frequency broadband airborne noise, includes a feedforward system sensor configured to capture a high-frequency noise signal generated in physical proximity to sources of noise for a vehicle; one or more physical error microphones configured to capture noise signals for cancellation; and an ANC computing device. The ANC computing device is configured to receive the noise signals from the one or more physical error microphones located at first locations within the vehicle, utilize a virtual microphone algorithm to estimate noise signals at a virtual location based on the noise signals, the estimation utilizing a transfer function that estimates a signal that would have been received by the one or more physical error microphones at the virtual location, receive the high-frequency noise signal from the feedforward system sensor, utilize the virtual microphone algorithm to estimate noise signals at the virtual location based on the high-frequency noise signal, and provide a noise-cancelling signal to cancel noise at the virtual location, the noise-cancelling signal accounting for the noise captured by both the feedforward system sensor and the one or more physical error microphones.

In one or more illustrative examples, a method for ANC of high-frequency broadband airborne noise is described. The method includes capturing, by a feedforward system sensor, a high-frequency noise signal generated in physical proximity to sources of noise for a vehicle; capturing, by one or more physical error microphones, noise signals for cancellation; receiving the noise signals from the one or more physical error microphones located at first locations within the vehicle; utilizing a virtual microphone algorithm to estimate noise signals at a virtual location based on the noise signals, the estimation utilizing a transfer function that estimates a signal that would have been received by the one or more physical error microphones at the virtual location; receiving the high-frequency noise signal from the feedforward system sensor; utilizing the virtual microphone algorithm to estimate noise signals at the virtual location based on the high-frequency noise signal; and providing a noise-cancelling signal to cancel noise at the virtual location, the noise-cancelling signal accounting for the noise captured by both the feedforward system sensor and the one or more physical error microphones.

In one or more illustrative examples, a non-transitory computer-readable medium includes instructions that, when executed by one or more processors of an ANC system, cause the ANC system to perform operations. These operations include to receive noise signals captured from one or more physical error microphones located at first locations within the vehicle, the noise signals lacking high frequency information in the 300 Hz to 1000 Hz frequency band; receive high-frequency noise signal from a feedforward system sensor, the high-frequency noise signal generated in physical proximity to sources of noise for the vehicle, the high-frequency noise signal covering frequencies in a 300 Hz to 1000 Hz frequency band; utilize a virtual microphone algorithm to estimate noise signals at a virtual location based on the noise signals, the estimation utilizing a transfer function that estimates a signal that would have been received by the one or more physical error microphones at the virtual location; utilize the virtual microphone algorithm to estimate noise signals at the virtual location based on the high-frequency noise signal; and provide a noise-cancelling signal to cancel noise at the virtual location, the noise-cancelling signal accounting for the noise captured by both the feedforward system sensor and the one or more physical error microphones, the ANC system utilizing a working frequency for the ANC of at least 2 kHz.

DETAILED DESCRIPTION

Figure 1:
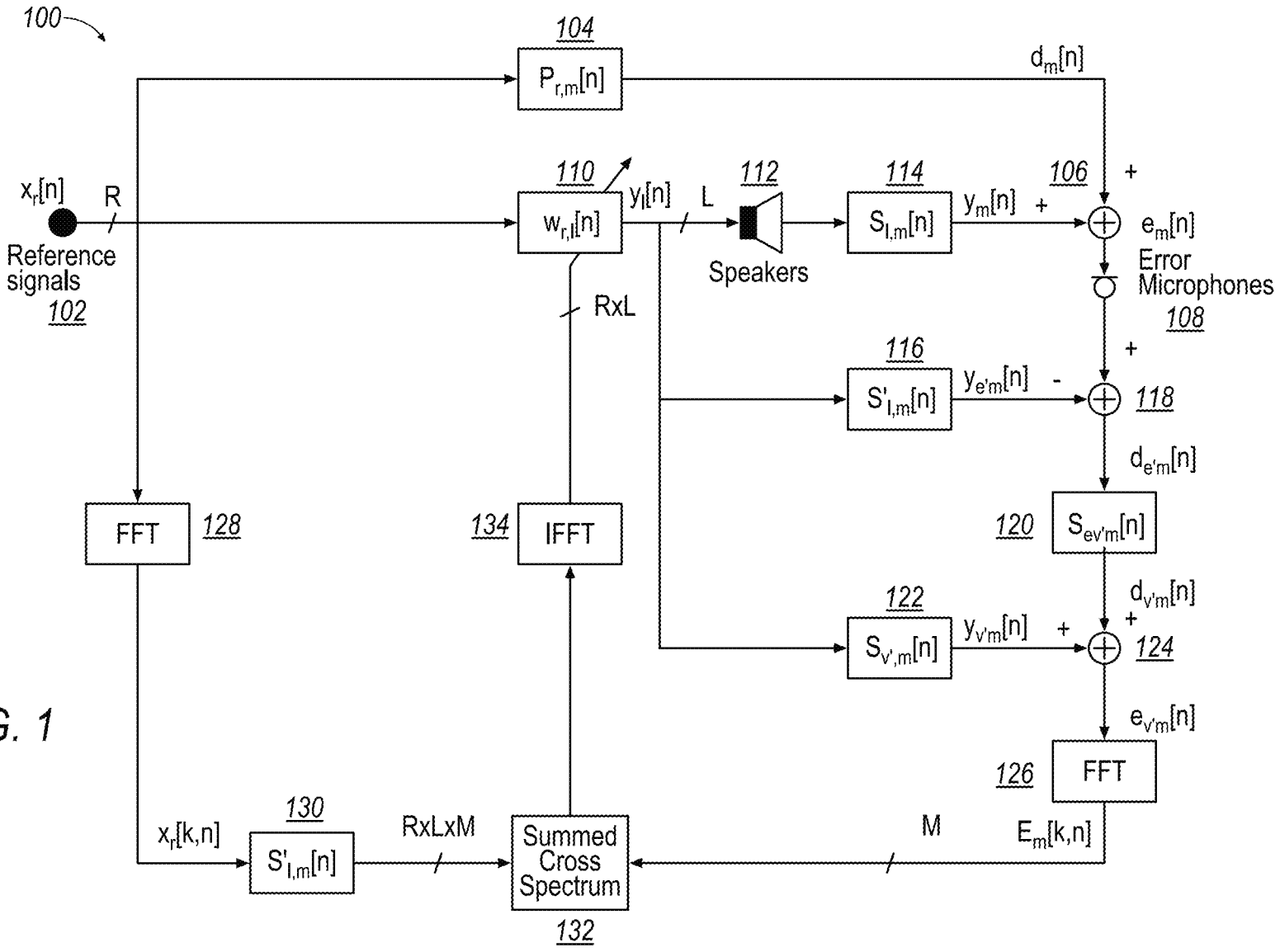
FIG. 1 illustrates an example system for using active noise cancellation (ANC) to perform road noise cancellation (RNC)
Figure 2A:
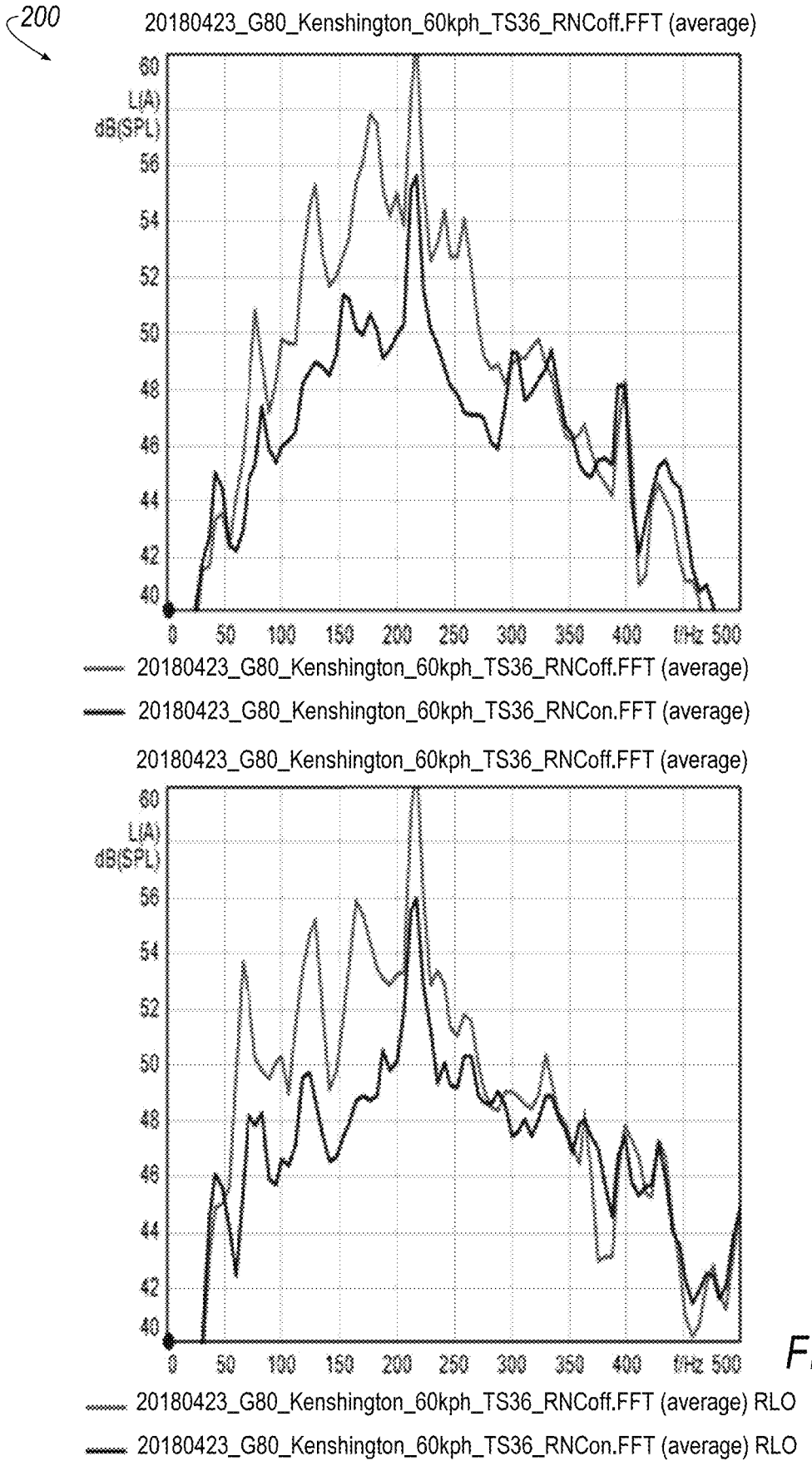
FIG. 2A illustrates a first portion of an example of RNC system performance.
Figure 2B:
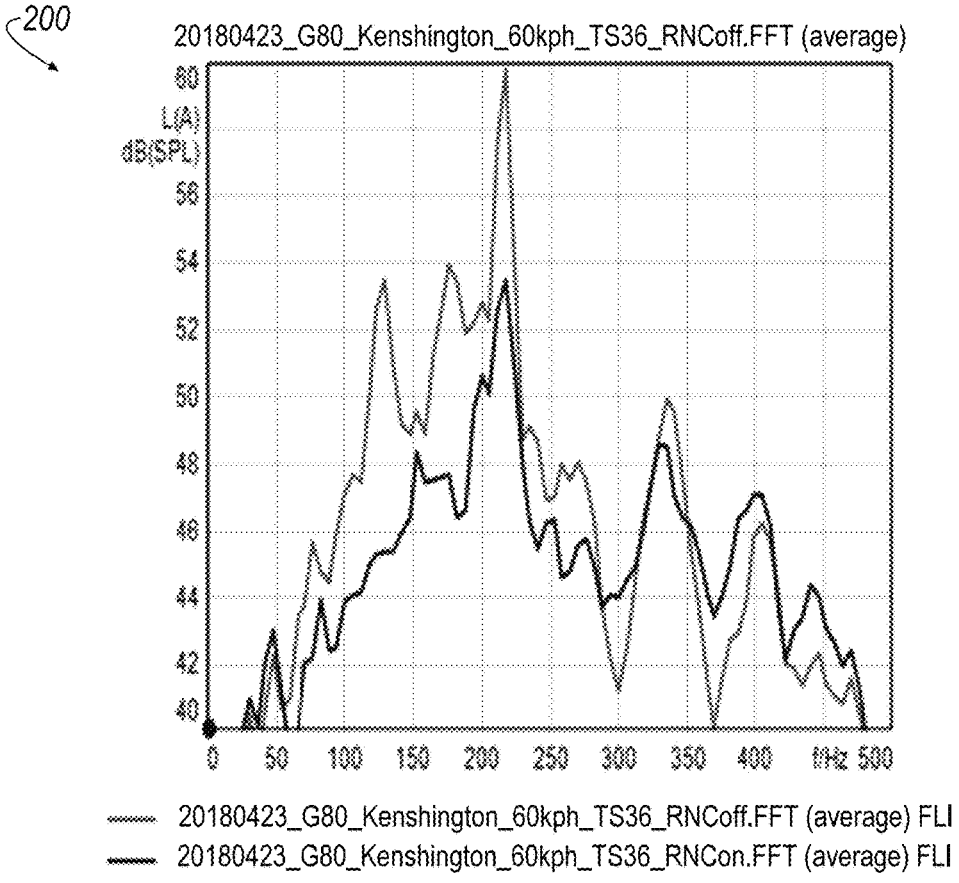
FIG. 2B illustrates a second portion of an example of RNC system performance.
Figure 2B:
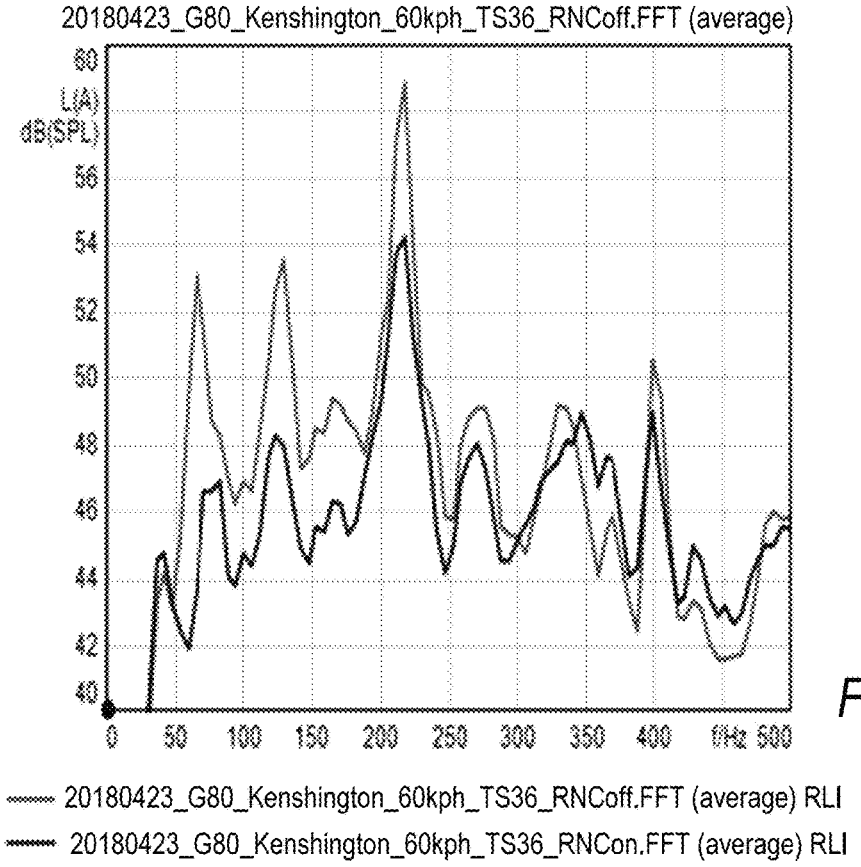
Figure 2C:
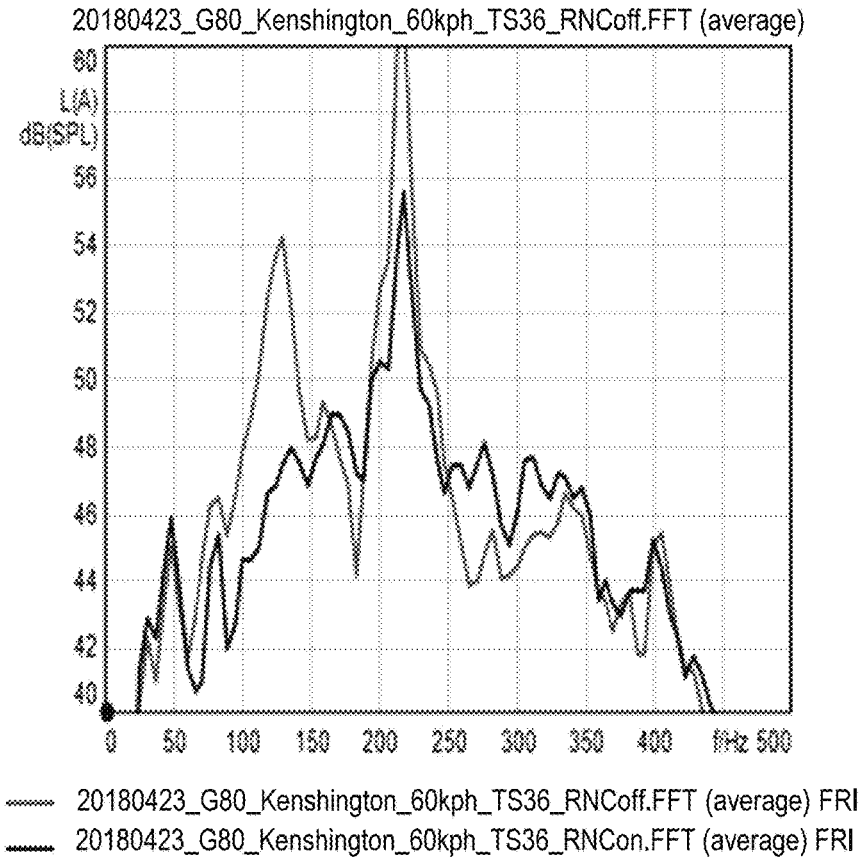
FIG. 2C illustrates a third portion of an example of RNC system performance.
Figure 2C:
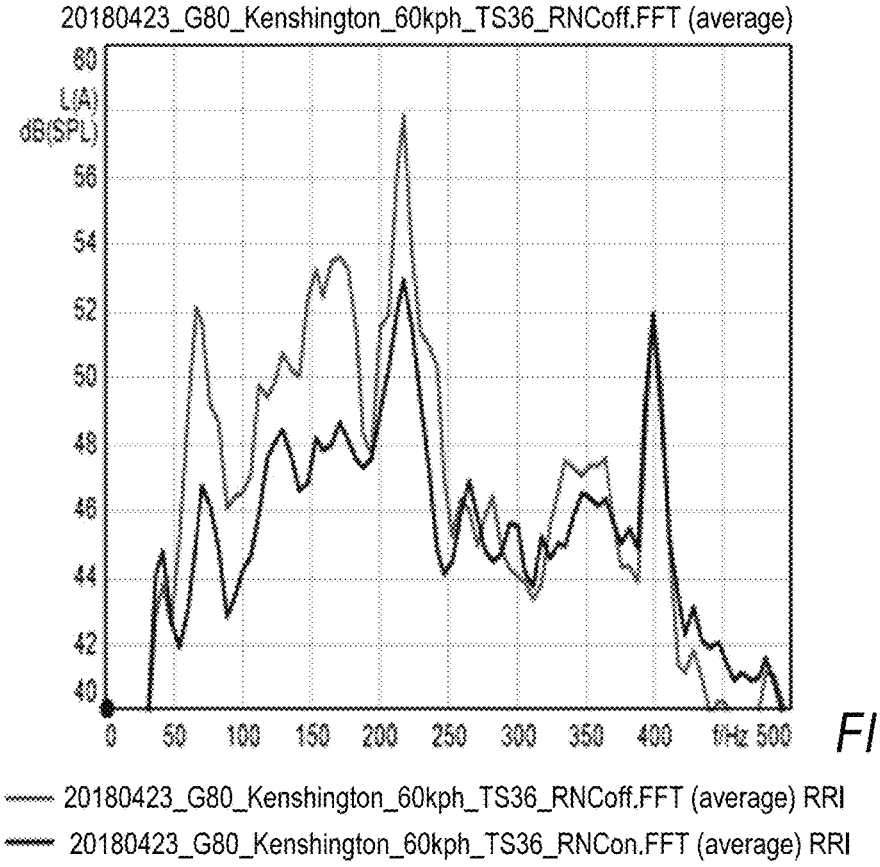
Figure 2D:
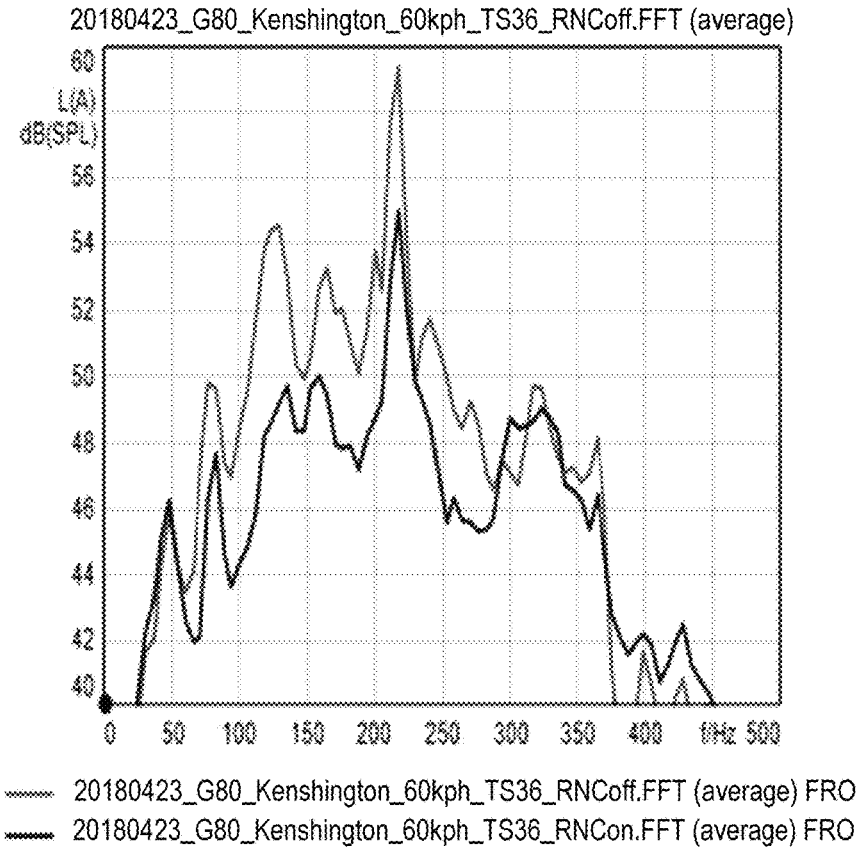
FIG. 2D illustrates a fourth portion of an example of RNC system performance.
Figure 2D:
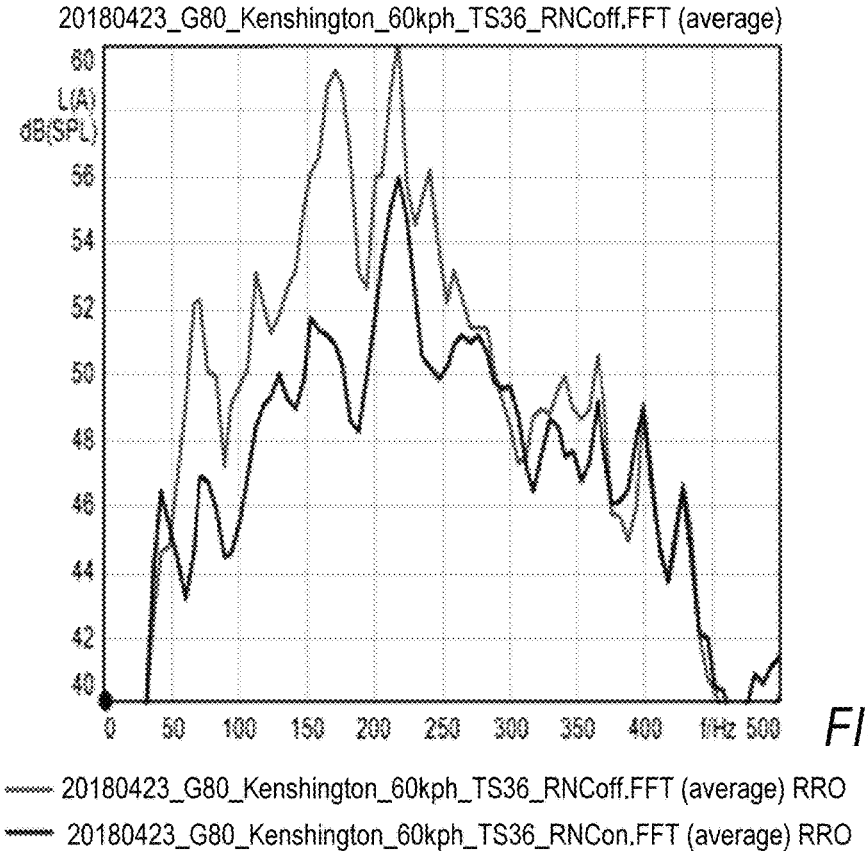

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Many RNC systems utilize accelerometers to capture the road excitation in either the vehicle chassis or body. Such systems effectively provide the RNC algorithm with a filtered-x signal below 250 Hz since most low-frequency cabin noise is structure born. However, it is very difficult, if not impossible, to achieve noise cancellation at high frequencies because such accelerometers typically provide only structure-borne source excitation. Airborne noise starts to contribute to the vehicle cabin noise above 200 Hz and becomes the major noise source above 500 Hz. Airborne noise, such as wind and road noise, dominate the vehicle interior noise in high-speed cruising conditions. Current passive wind noise solutions using interlayer glass typically show benefits only in the frequency range above 1.5 kHz. Therefore, a high frequency ANC system covering the 300 Hz to 1000 Hz band of frequencies would be a unique and attractive solution for in-vehicle noise reduction.

To improve the high frequency noise cancellation, additional sensors may be added to provide additional information for the RNC. These sensors may include microphones and/or hot wire sensors located on the exterior of the vehicle. Additionally, processing may be performed using velocity signals, rather than acceleration signals. These and other aspects are discussed in detail herein.

FIG. 1 illustrates an example system 100 for using ANC to perform road noise cancellation (RNC). As a convention in the system 100, let L be the number of loudspeakers, M be the number of microphones, R be the number of reference signals (e.g., channels of measured noise source), [k] be the $k^{th}$ sample in frequency domain, and [n] be the $n^{th}$ sample or $n^{th}$ frame in time domain.

As shown, the R reference signals 102 indicate sensed signals that are physically close to sources of noise, and that traverse a physical path 104. Because the reference signals 102 are close to the noise sources, they may offer a signal that is leading in time. The reference signals 102 may be noted as $x_r[n]$, where r=1 . . . R, as a vector of dimension R, representing the time-dependent reference signals 102 in the time domain. The physical path 104 may be noted as $p_{r,m}[n]$, where r=1 . . . R and m=1 . . . M as a matrix of R×M, representing the time-dependent transfer functions of the primary paths in the time domain. The noises originated from the reference signals 102 along with sounds from the loudspeakers 112 are combined in the air 106 and received by M error microphones 108.

The R reference signals 102 may also be input to an adaptive filter 110, which may be a digital filter configured to dynamically adapt to filter the reference signals 102 to produce a desired, anti-noise signal as output. The adaptive filter 110 may use the notation of $w_{r,l}[n]$, representing the time dependent adaptive w-filters in time domain, where r=1 . . . R and l=1 . . . L, giving a matrix of R×L. As indicated by its name, the adaptive filter 110 changes instantaneously, adapting in time to perform the adaptive function of the ANC system 100.

The output signals from the adaptive filter 110 may be applied to the inputs to the loudspeakers 112. These output signals may be of the form $y_l[n]$, where l=1 . . . L, with one signal for each loudspeaker 112. Based on the inputs, the loudspeakers 112 may, accordingly, produce speaker outputs as acoustical sound waves that traverse an acoustic physical path 114 from the loudspeakers 112 via the air 106 to the error microphones 108. The physical path 114 may be represented by the transfer function $s_{l,m}[n]$, where l=1 . . . L and m=1 . . . M, creating a matrix of L×M, representing the time dependent transfer functions of the acoustic paths in the time domain. Thus, both the R reference signals 102 traversing the primary physical path 104 and the speaker outputs traversing the acoustic physical path 114 are combined in the air 106 to be received by the M error microphones 108.

The M error microphones 108 may generate M error signals based on the received acoustic energy. The error signals may be referenced in the form $e_m[n]$, where m=1 . . . M, the vector of dimension M, representing the error microphone signals in time domain. Typically, the error microphones 108 may be located in the vehicle headliner, although other in-vehicle locations may be used.

To improve performance of the ANC system at the location of passengers in the vehicle, a remote microphone algorithm may be used. The remote microphone algorithm may estimate the noise signal at the ear or other virtual microphone location using the noise signal received by the physical microphones 108. For example, the remote microphone algorithm may be used to estimate the noise signals at the locations of the user's ears, based on signals received from error microphones 108 located elsewhere in the vehicle cabin, such as in the vehicle headliner.

The remote microphone algorithm requires a preliminary identification stage in which a second physical microphone is temporarily placed at the virtual location. Estimates of secondary transfer functions at the physical and virtual locations are then measured using the temporary microphone during a preliminary identification stage along with an estimate of the primary transfer function between the physical and virtual locations. These transfer functions are then used at runtime to estimate the signal that would have been received by a microphone at the location of the virtual microphone, using the signals received from the physical microphones 108.

More specifically, the output signals $y_l[n]$ from the adaptive filter 110 may be provided to a speaker-to-error-microphone filter 116. This filter 116 may process the signals $y_l[n]$ using a transfer function $S'_{l,m}[n]$ from the speakers 112 to the error microphones 108, thereby generating estimated control signals at the error microphones 108, referred to herein as $y_{e'm}[n]$. These estimated control signals may be added to the microphone error signals $e_m[n]$ using an adder 118, resulting in estimated disturbance signals at the error microphones 108. These disturbance signals may be of the form $d_{e'm}[n]$.

The disturbance signals $d_{e'm}[n]$ may then be applied to an error-microphone-to-virtual-microphone filter 120. This filter 120 may process the disturbance signals $d_{e'm}[n]$ using a transfer function $S_{ev'm}[n]$ from the error microphone signals to virtual microphone signals. The result of this filtering are estimated disturbance signals at the virtual microphone, referred to herein as $d_{v'm}[n]$.

The output signals $y_l[n]$ from the adaptive filter 110 may also be provided to a speaker-to-virtual-microphone filter 122. This filter 122 may process the signals $y_l[n]$ using a transfer function $S_{v'm}[n]$ from the speaker 112 to virtual microphones, thereby generating estimated control signal at the virtual microphone(s), referred to herein as $y_{v'm}[n]$.

Finally, an adder 124 may receive the disturbance signals at the virtual microphones $d_{v'm}[n]$ and the estimated control signal at the virtual microphone $y_{v'm}[n]$, which may be added to produce error signals for the virtual microphones. These error signals may be of the form $e_{v'm}[n]$, and may represent the error signals at the locations of the virtual microphones, rather than the error at the locations of the actual error microphones 108.

A Fast Fourier Transform (FFT) 126 may be utilized to convert the virtual microphone error signals $e_{v'm}[n]$, into frequency domain error signals. The frequency domain error signals may be referenced as $E_m[k, n]$, where m=1 . . . M, vector of dimension M, representing the time dependent error microphone signals in the frequency domain.

The R reference signals 102 may also be input to FFT 128, thereby generating frequency-domain reference signals. The frequency domain reference signals may be noted as $X_r[k, n]$, where r=1 . . . R, the vector of dimension R, representing the time-dependent reference signals in the frequency domain.

The estimated path filter 130 may provide an estimated output signal representing the time dependent, processed frequency-domain reference signals, filtered with the modeled transfer characteristic $S'_{l,m}[n]$. The estimated output signal may be referred to in a matrix of R×L×M. The estimated output signal from the estimated path filter 130 is transmitted to the sum cross-spectrum comparator 132.

The sum cross-spectrum comparator 132 may be an adaptive filter controller 132 configured to provide a vector to apply filter coefficients of the least mean square of the error signals. The adaptive filter 110 is often referred to as a W-filter. The adaptive filter controller 132 adapts W to minimize error signals. The process of adapting W that results in improved cancellation is referred to as convergence. Convergence refers to the convergence of the ANC algorithm, which is controlled by the step size that governs the rate of adaption for the given circumstances. This scaling factor dictates how fast the algorithm will converge to the desired level of cancellation by limiting magnitude change of the W-filters based on each incoming W-filter. The output of the sum cross-spectrum comparator 132 may be applied to an inverse FFT 134, thereby generating time-domain signals to drive the adaptive filter 110.

The adaptive filter controller 132 may implement various learning algorithms, such as least mean squares (LMS), recursive least mean squares (RLMS), normalized least mean squares (NLMS), or any other suitable learning algorithm. The adaptive filter controller 132 also receives as an input the frequency domain error signals from the FFT 126 that are indicative of the time dependent error microphone signals in the frequency domain. The output of the adaptive filter controller 132 may be of the form of an update signal transmitted to the adaptive filter 110. Thus, the adaptive filter 110 is configured to receive both the undesired noise source $X_r(n)$ and the IFFT 134 output signal via adaptive filter controller 132. The adaptive filter controller 132 output post IFFT 134 is transmitted to the adaptive filter 110 in order to more accurately cancel the undesired noise source $X_r(n)$ by providing the anti-noise signal.

FIGS. 2A-D collectively illustrate an example 200 of RNC system performance. As shown, the example performance is utilizing an ANC system, such as the system 100, implementing virtual microphone technology. As shown, the example graphs of the example 200 are for a vehicle traveling at sixty kilometers per hour. A first trace for each graph indicates the sound pressure level (SPL) of noise in decibels (dB) with the RNC system active, while a second trace for each graph indicates the SPL of noise in dB with the RNC system inactive. Notably, at higher speed, high frequency noise is more prevalent.

Figure 3:
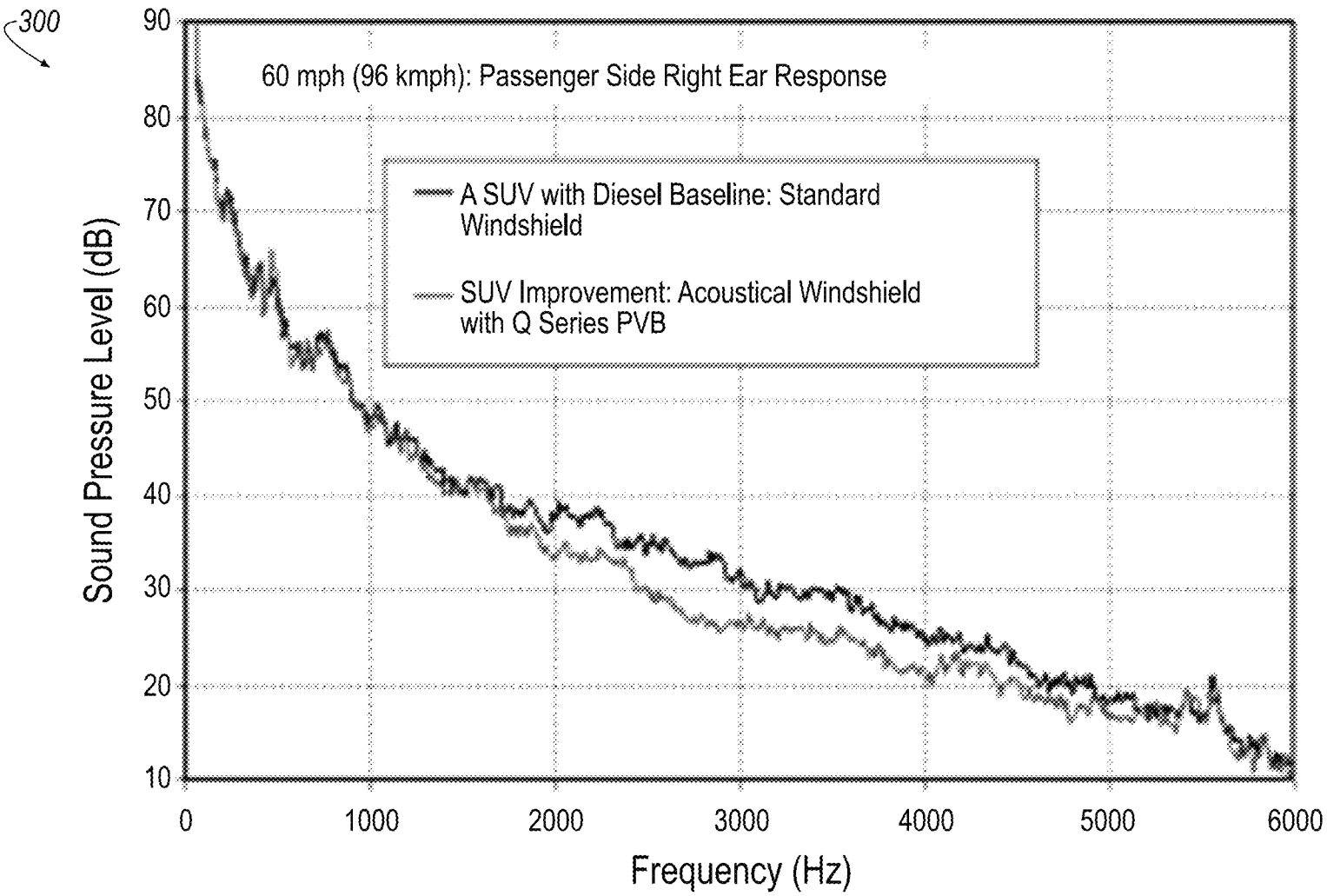
FIG. 3 illustrates an example of performance of a passive wind noise solution using laminated glass.

FIG. 3 illustrates an example 300 of performance of a passive wind noise solution using laminated glass. The example 300 illustrates two traces of passenger side right ear response at ninety-six kilometers per hour, showing SPL of noise in dB for frequencies from 0 to 6000 Hz. The upper trace illustrates noise for a diesel SUV with a standard windshield, while the lower trace shows the same SUV using an acoustical windshield. As can be seen, the acoustical windshield provides some improvement in acoustics, although mostly at frequencies from about 1.5 kHz to about 5 kHz.

For high frequency ANC, e.g. covering the 300 Hz to 1000 Hz frequency band, airborne noise sources may be useful to capture and provide signals to the ANC algorithm. Airborne noise sources for the vehicle may be captured outside the vehicle with microphones or hot-wires, or in the airborne noise paths, such as side windows, windshields, and body panels, by using accelerometers.

Figure 4:
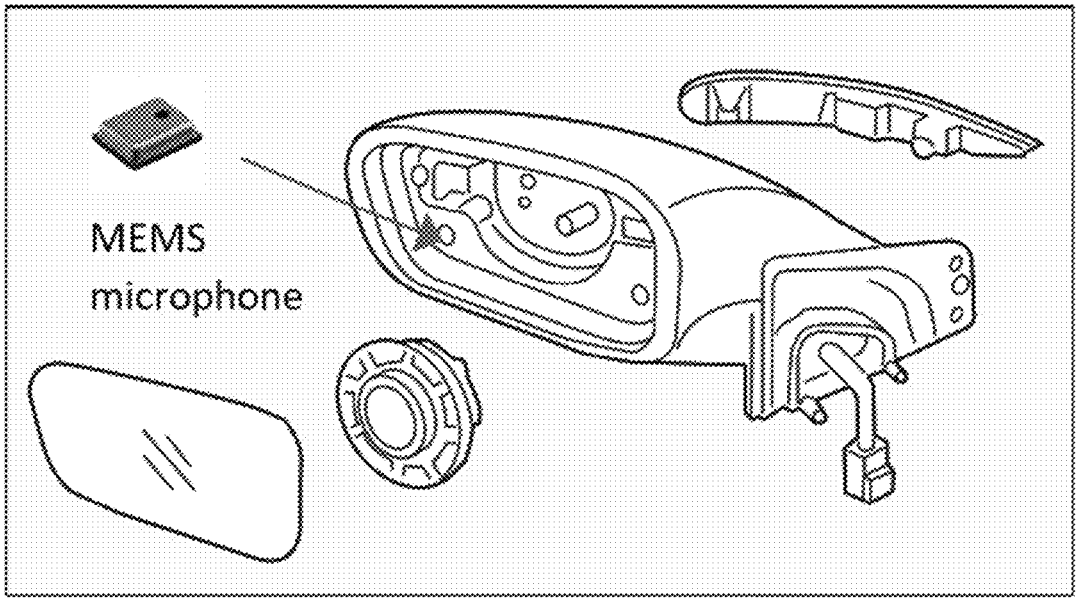
FIG. 4 illustrates an example of microphone placement on the exterior of the vehicle for use in providing data for ANC.
Figure 4:
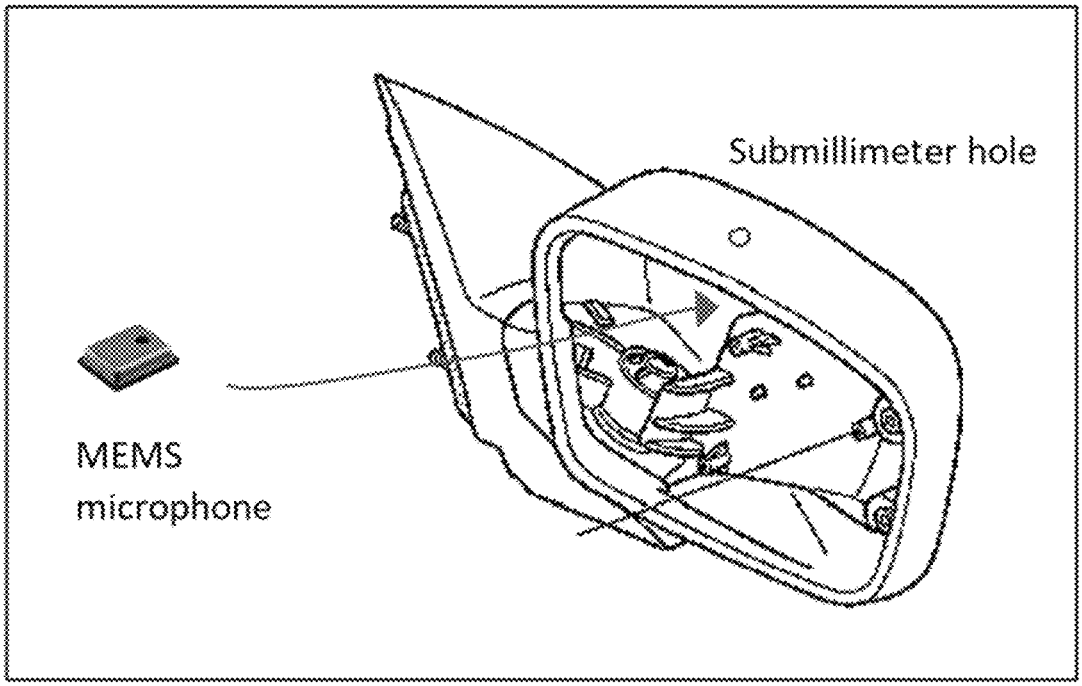

FIG. 4 illustrates an example 400 of microphone placement on the exterior of the vehicle for use in providing data for ANC. In general, airborne noise sources should be captured close to the noise sources. For example, a vehicle side mirror is one of the dominant sources of wind noise. A significant quantity of aero-acoustic noise may be generated surrounding the side mirror, due to the complicated turbulent airflow caused by travel of the vehicle with the side mirror cutting through the air. Microphones may be located inside the side mirror housing to detect the frequency content of wind noise. In this way, the microphone may be less susceptible to self-noise due to airflow and interference with the existing airflow. It may be important to minimize self-noise when microphones are located outside the vehicle. Other candidate locations are A-pillar, vehicle cowl, vehicle underbody, inside the door handle, wheel arch, etc. As shown in the example 400, a microelectrical-mechanical system (MEMS) microphone may be included inside the mirror housing, or, in the alterative, may be internally flush-mounted at a submillimeter hole to the surface of the mirror.

Figure 5:
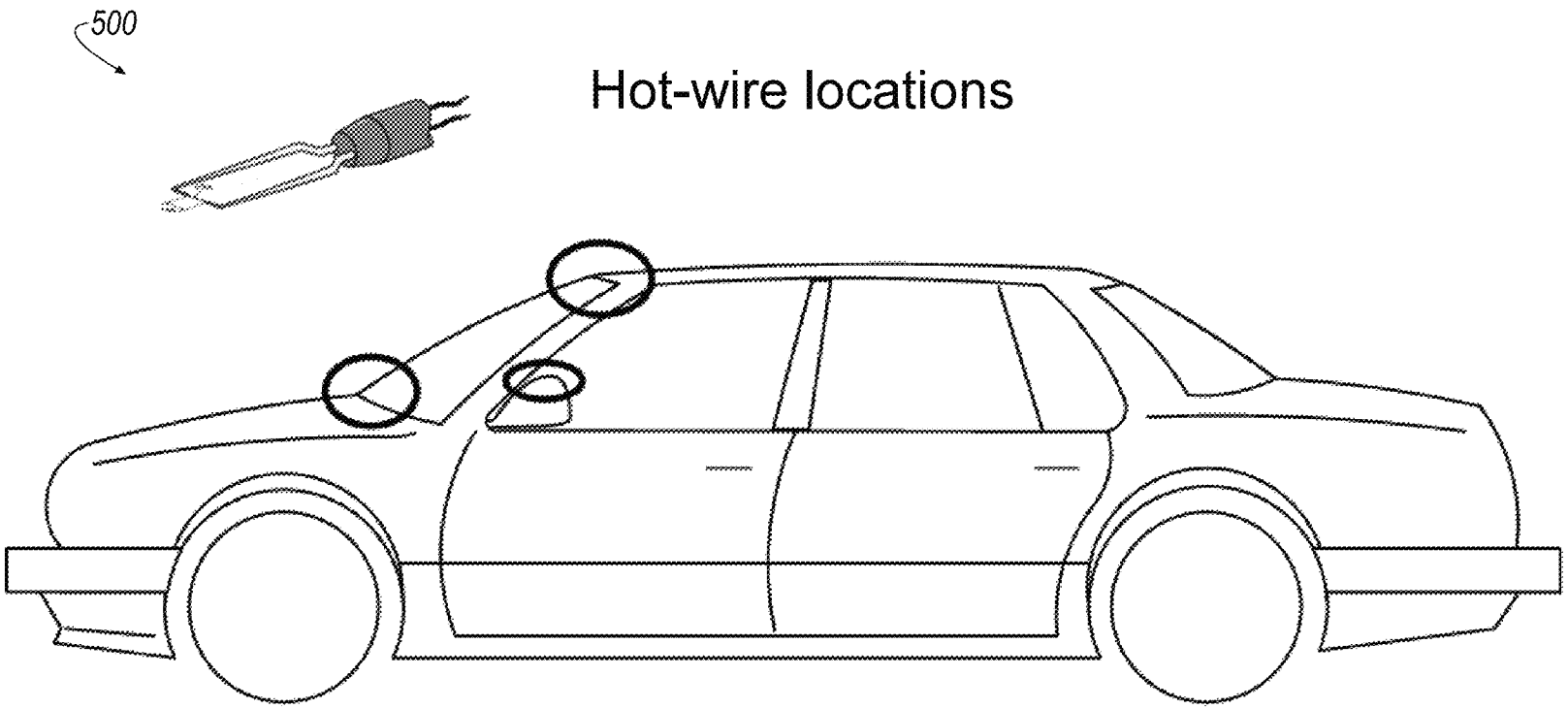
FIG. 5 illustrates an example of hot-wire or hot-film placement on the exterior of the vehicle.

FIG. 5 illustrates an example 500 of hot-wire or hot-film placement on the exterior of the vehicle. Airborne noise sources may be captured close to the noise sources with a hot-wire. It is particularly useful when the sensor is exposed to the airflow generating the noise. For instance, as shown in the example 500, a hot-wire may be mounted inside a front bumper to measure the aero-acoustic noise due to impinging flow. Other candidate locations for the hot-wire may include an A-pillar, a vehicle cowl, etc.

In another example of the disclosure, an accelerometer may be placed in the airborne noise path. Regardless of noise source types, noise is transmitted through either vehicle glasses or body panels. The vehicle side glass is one of the dominant airborne noise paths. Accelerometers can be used to detect the vibration of glasses and panels. This approach has the advantage that both airborne and structure-borne noises may be captured with the accelerometers. Vehicle suspension and underbody panels are currently used for conventional RNC, but they only provide structure-born road noise. Other candidate locations include the windshield, a sunroof, a rear windshield, interior body panels, etc. In an example, the accelerometer may be mounted in the very bottom of the side window which is hidden in the door panel to avoid visual interference.

In yet another aspect of the disclosure, anti-noise signal calculation may be performed by using surface velocity information. Notably, acoustic pressure radiated by a vibratory source is directly proportional with vibration velocity. Therefore, surface velocity of a vehicle panel would show higher correlation with interior noise than acceleration. The surface velocity of the panel may be obtained by integrating a measured acceleration signal. Current FX-RNC algorithms may utilize acceleration to compute anti-noise signals. However, convergence time of such systems may be improved by utilizing the velocity signal.

As an even further aspect of the disclosure, virtual microphone estimation may be performed using an accelerometer signal. As shown in the example system 100, virtual microphone technique may be used in a RNC algorithm. Spatial variation of high-frequency noise fields can be mitigated by use of the virtual microphone algorithm. For instance, the virtual microphone locations may be simulated as being at the location of ears of a human in the vehicle, while the locations of the physical microphones are in the headliner. However, for high frequency ANC, headliner microphones may lack sufficient high frequency information to allow for an anti-noise signal to be generated at those frequencies. To address this, accelerometers either can replace physical error microphones or be used in combination with the physical error microphones to improve accuracy of ANC of the RNC system.

In an additional aspect of the disclosure, error microphone location may be improved by using the virtual microphone technique. As shown in the example system 100, virtual microphone technique may be used in a RNC algorithm. Spatial variation of high frequency noise field can be mitigated by virtual microphone algorithm. For instance, the virtual microphone locations may be simulated as being at the location of the human ears, while the physical locations of the microphones are in the headliner. However, for high frequency ANC, headliner microphones may lack sufficient high frequency information to allow for an anti-noise signal to be generated at those frequencies. Moreover, the error microphone locations may require careful selection. Error microphones located in the headrest may additionally be used to estimate noise at the location of the ears of a human in the vehicle.

Figure 6:
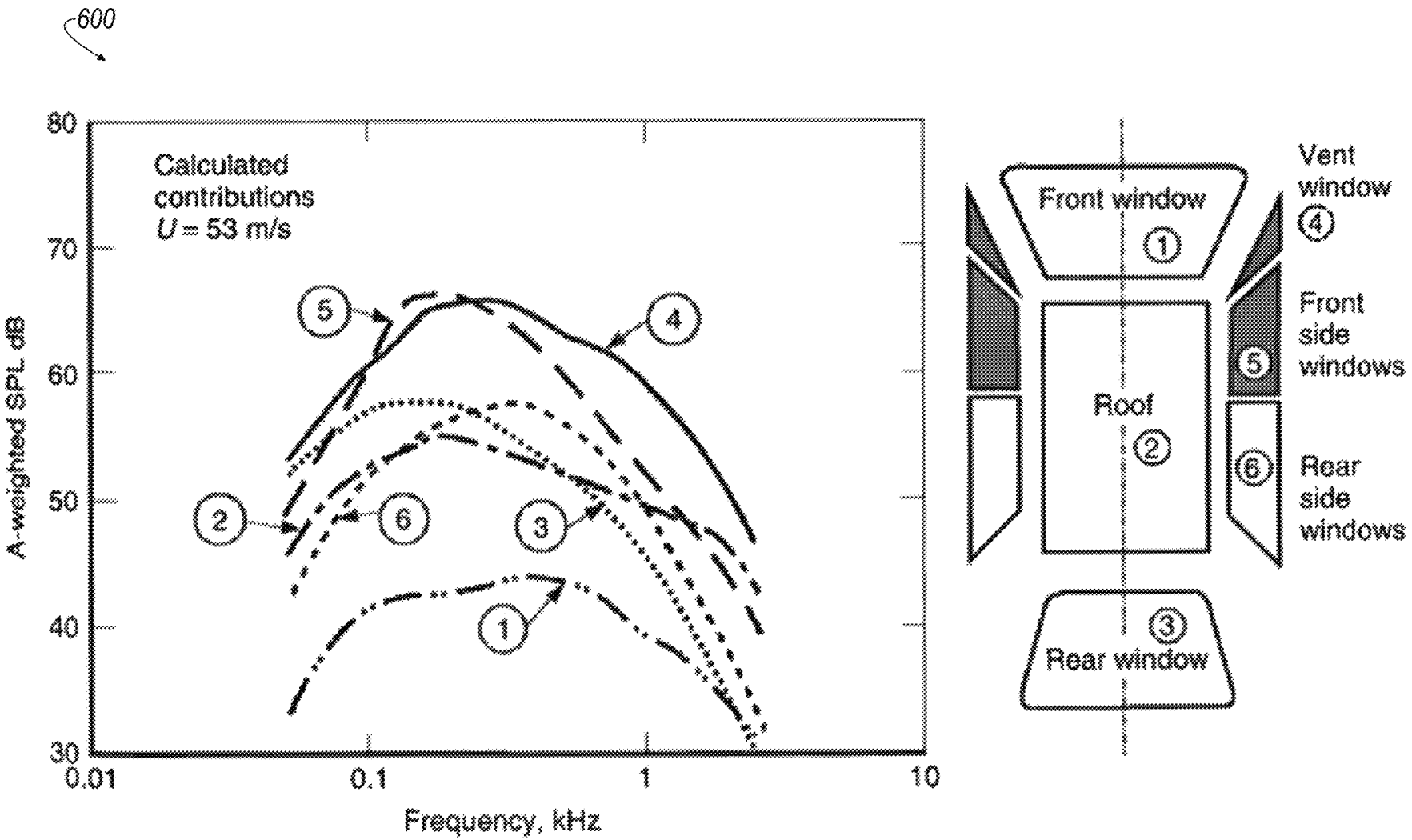
FIG. 6 illustrates an example of wind noise contribution from different areas of a body of a vehicle.

FIG. 6 illustrates an example 600 of wind noise contribution from different areas of a body of a vehicle. Each trace of noise is provided as an estimated A-weighted SPL contribution from different areas of the automobile body at the ear level of the driver. For instance, the first trace shows the contribution at the front windshield, the second trace shows the contribution at the roof, the third trace shows the contribution at the rear windshield, the fourth trace shows the contribution at the front passenger vent window, the fifth trace shows the contribution at the passenger front side window, and the sixth trace shows the contribution at the passenger rear side window. Notably, the maximum SPL occurs around 300 Hz to 1000 Hz.

Figure 7:
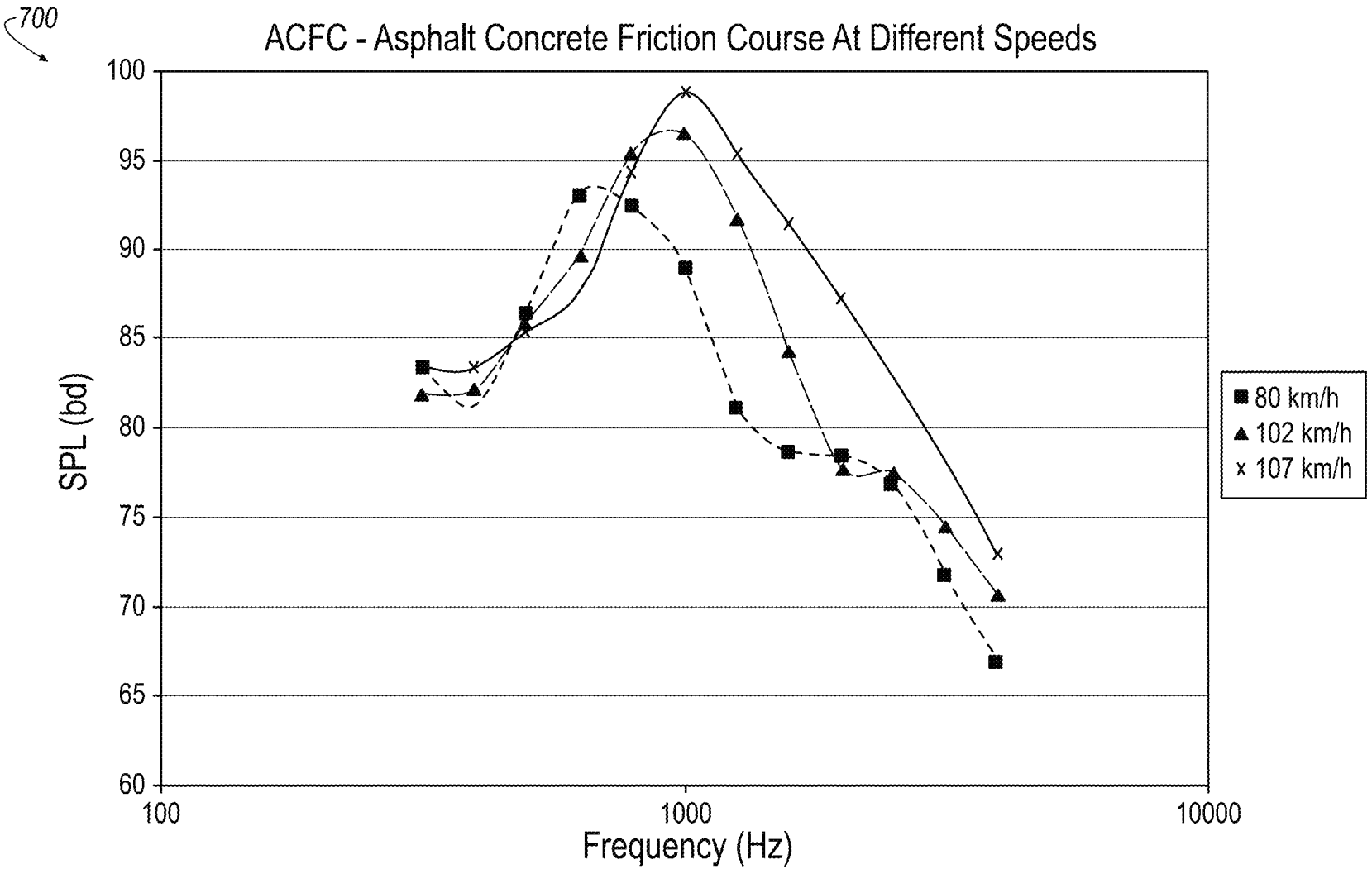
FIG. 7 illustrates an example of airborne tire noise spectra.

FIG. 7 illustrates an example 700 of airborne tire noise spectra. Specifically, the diagram illustrates A-weighted SPLs using one-third octave band tire/road noise measurements made with a close proximity trailer over an asphalt concrete friction course at different speeds. A first trace, denoted by squares, provides SPLs for a vehicle traveling at eighty kilometers per hour. A second trace, denoted by triangles, provides SPLs for a vehicle traveling at one hundred and two kilometers per hour. A third trace, denoted by crosses, provides SPLs for a vehicle traveling at one hundred and seven kilometers per hour. Notably, the maximum noise again occurs around 1000 Hz, which may be difficult to handle with ANC unless additional sources of high-frequency noise are available for analysis by the ANC.

Figure 8:
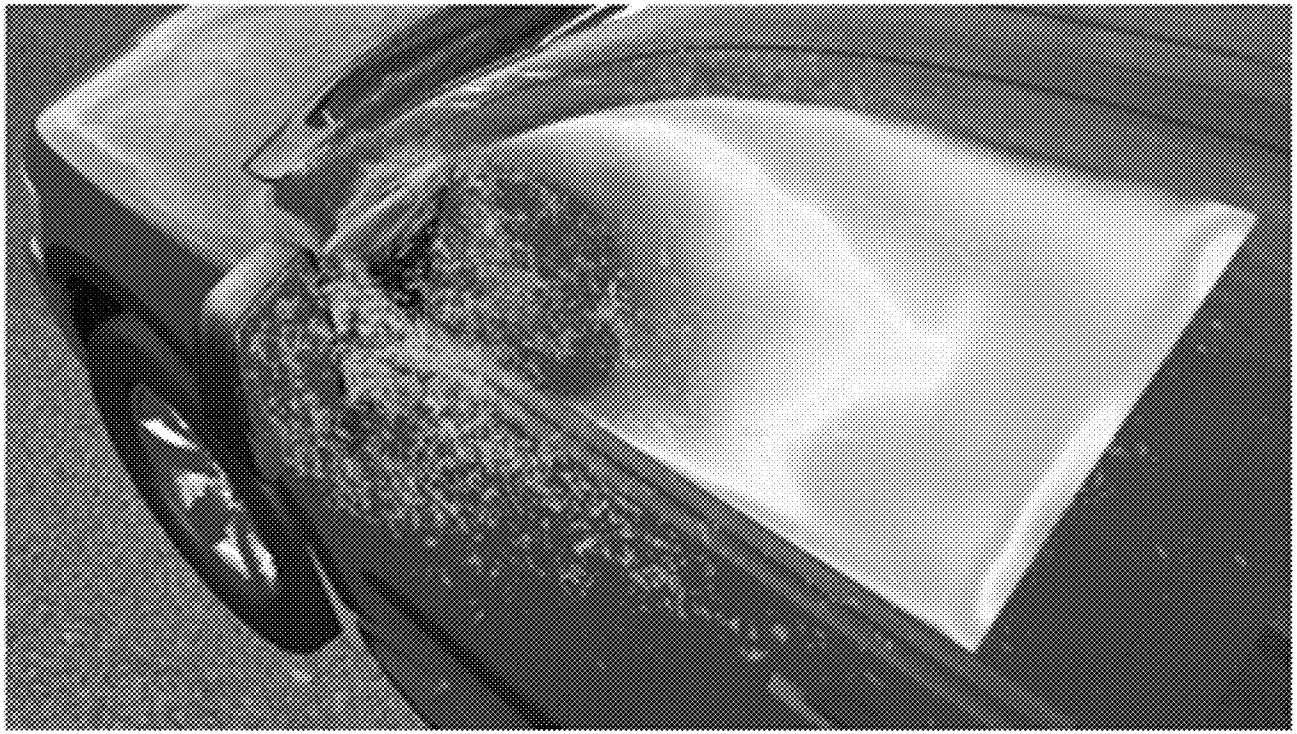
FIG. 8 illustrates an example of a wind noise source around an outside mirror of a vehicle.
Figure 9A:
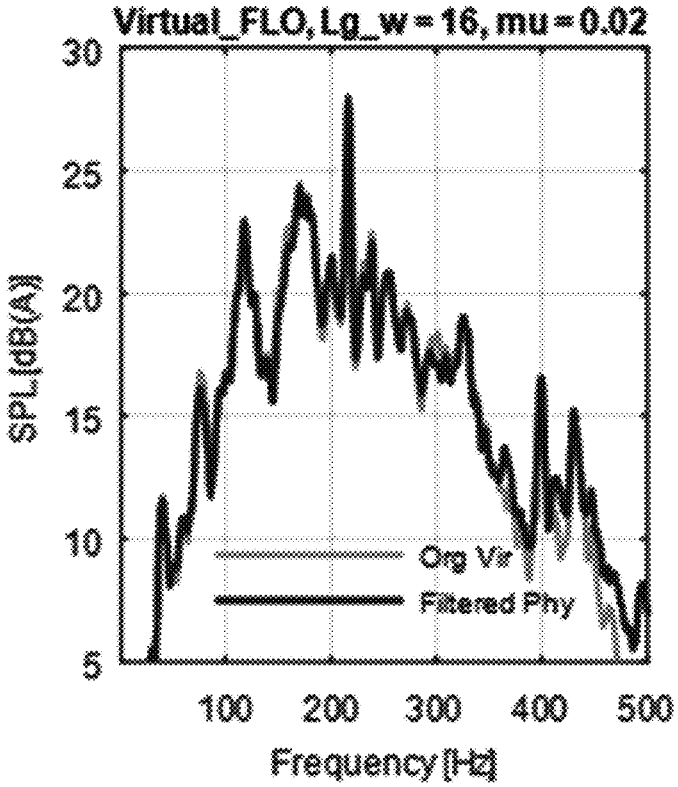
FIG. 9A illustrates a first portion of an example of virtual microphone noise estimation.
Figure 9A:
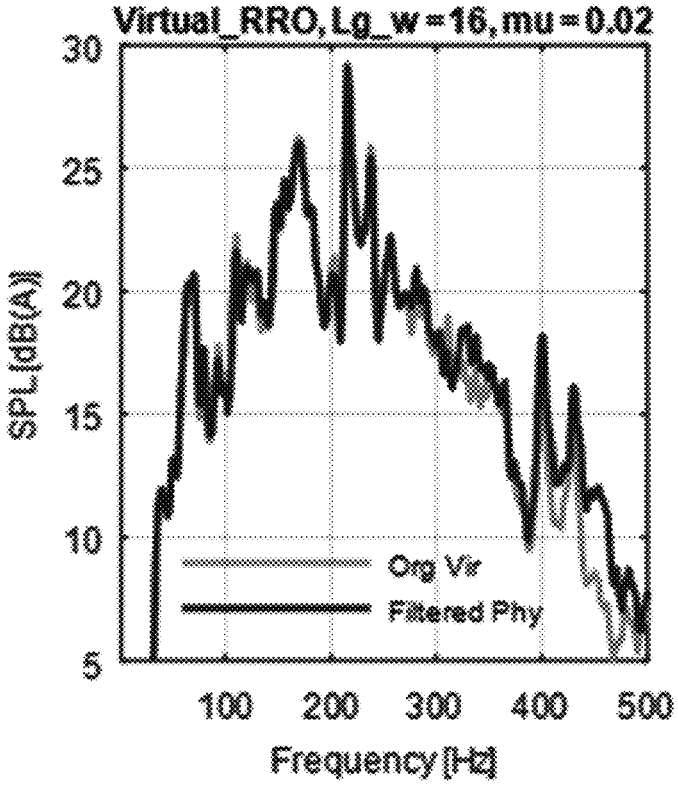
Figure 9B:
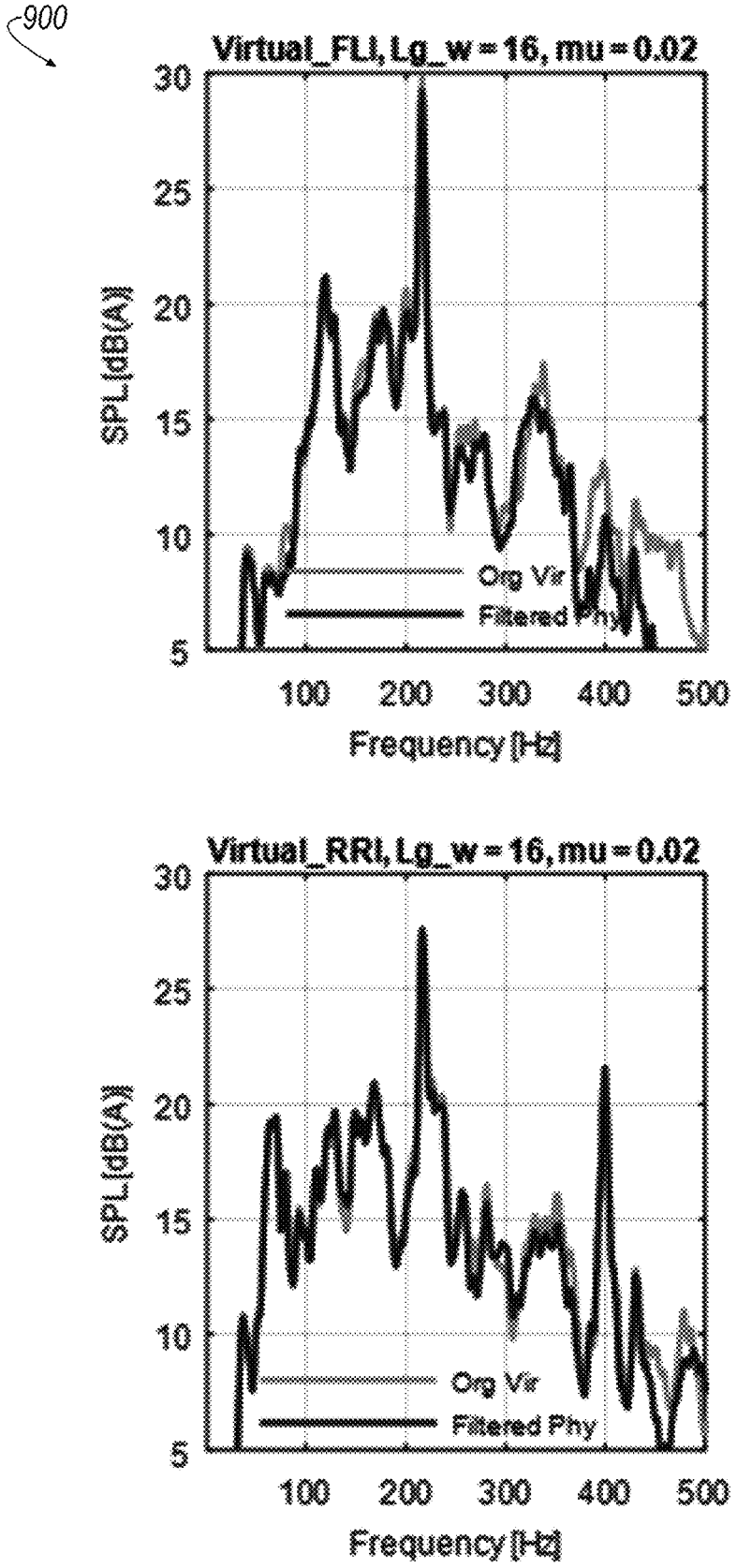
FIG. 9B illustrates a second portion of an example of virtual microphone noise estimation.
Figure 9C:
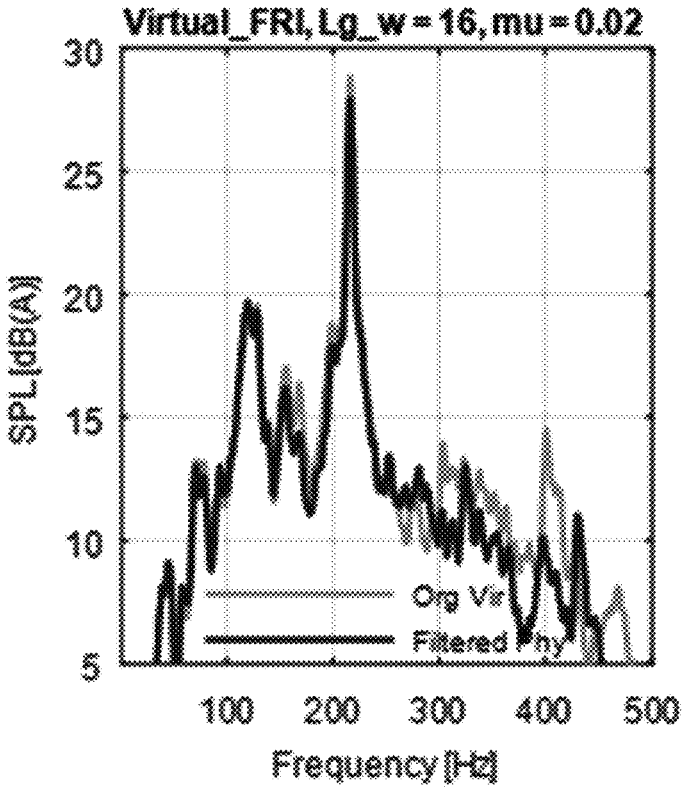
FIG. 9C illustrates a third portion of an example of virtual microphone noise estimation.
Figure 9C:
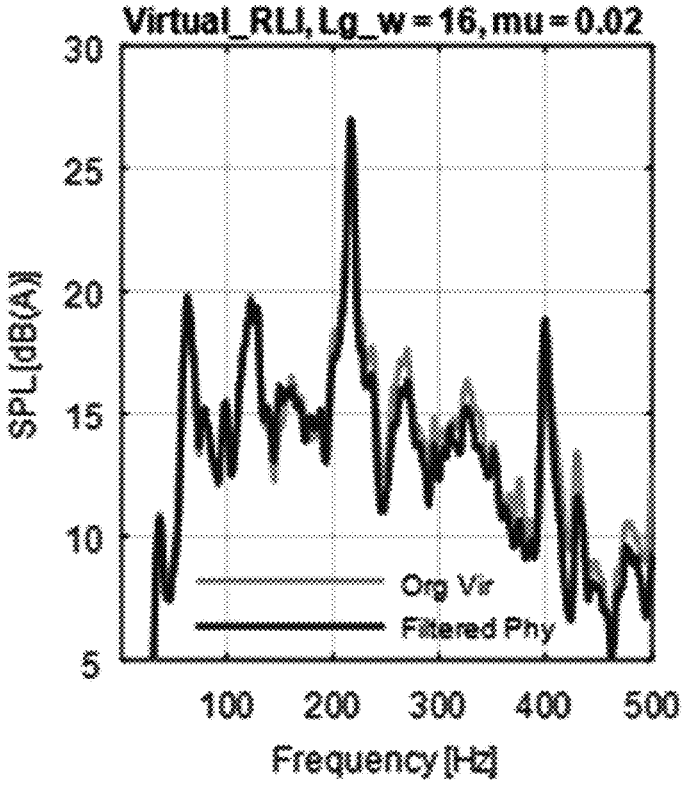
Figure 9D:
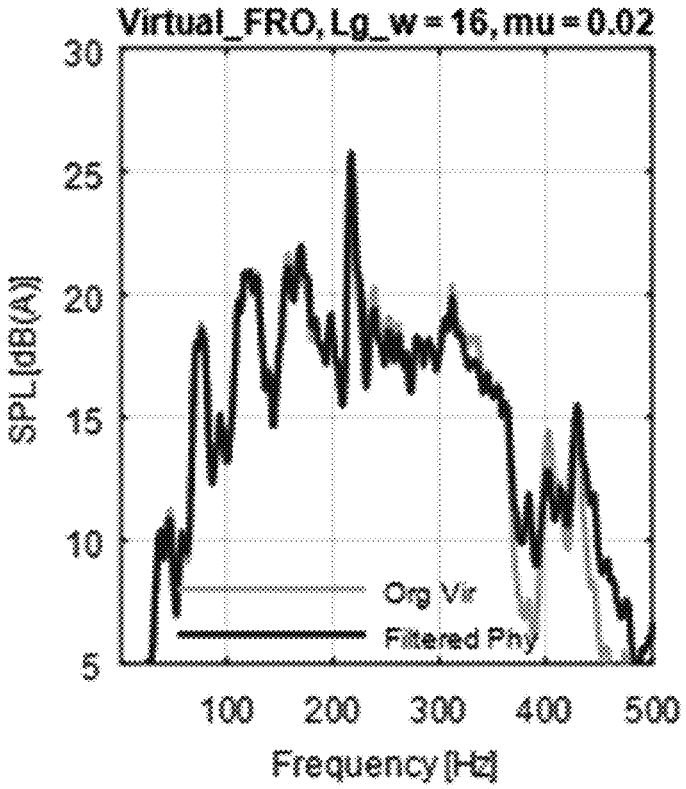
FIG. 9D illustrates a fourth portion of an example of virtual microphone noise estimation.
Figure 9D:
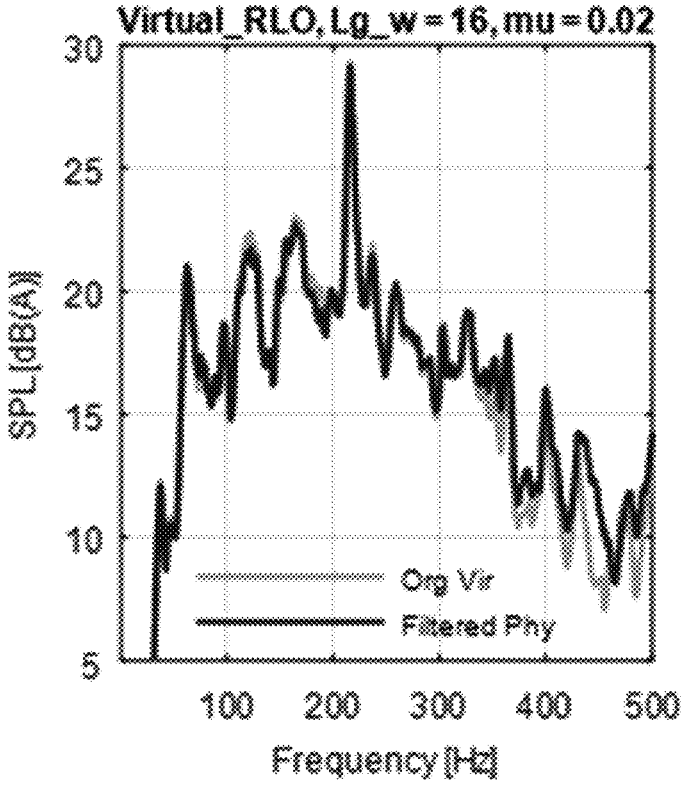

FIG. 8 illustrates an example 800 of a wind noise source around an outside mirror of a vehicle. As illustrated, the example 800 shows a dB map of acoustic pressure on the side glass and isosurfaces of acoustic noise sources.

Spatial variation of high frequency noise fields can be mitigated by use of the virtual microphone algorithm described above. Physical microphone locations may be adjusted to capture additional airborne noise sources.

FIGS. 9A-D collectively illustrate an example 900 of virtual microphone noise estimation. Notably, the high-frequency RNC system may utilize a higher working frequency than ANC algorithms that do not cancel high-frequency noise, which typically utilize a working frequency of 1.5 kHz, considering Nyquist criterion. Depending on the target frequency range, a working frequency for the ANC may be increased to 2.5 kHz or above to adequately cancel high-frequency noise in the area of 1 kHz and above.

Figure 10:
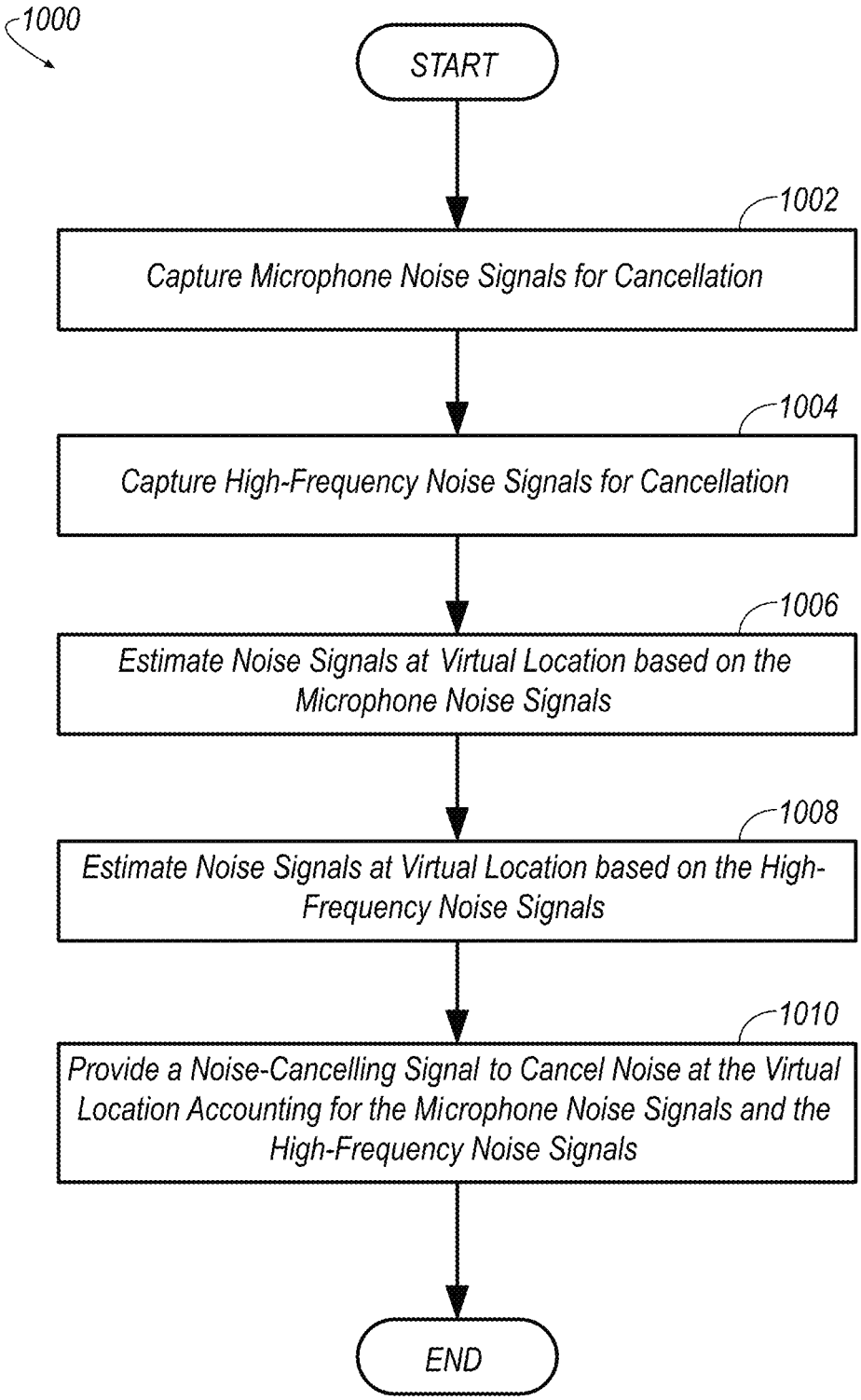
FIG. 10 illustrates an example process for the active noise cancellation for high-frequency broadband airborne noise.

FIG. 10 illustrates an example process 1000 for the active noise cancellation for high-frequency broadband airborne noise. In an example, the process 1000 may be performed by an ANC computing device, such as the system 100 as discussed in detail herein.

At operation 1002, noise signals for cancellation are captured by one or more physical error microphones 108. In an example, these noise signals are received to the ANC computing device from the one or more physical error microphones 108 located at first locations within the vehicle. These locations may include, for instance, locations in the headliner of the vehicle cabin.

At operation 1004, high-frequency noise signals are captured in physical proximity to sources of noise for the vehicle. The high-frequency noise signal may cover frequencies in a 300 Hz to 1000 Hz frequency band, as the one or more physical error microphones 108 may lack high frequency information in the 300 Hz to 1000 Hz frequency band for an anti-noise signal to be generated at those frequencies.

In an example, these high-frequency noise signals are captured by a feedforward system sensor. This sensor may include, as some examples, a MEMS microphone, a hot-wire sensor, and/or an accelerometer. The MEMS microphone may be located inside an outside mirror of a vehicle, to allow the MEMS microphone to capture wind noise of the vehicle. The MEMS microphone may be coupled to outside air per a submillimeter hole in the outside mirror to minimize self-noise from the MEMS microphone. The MEMS microphone is located inside a wheel well of a vehicle to perform road noise detection. The hot-wire sensor may be configured to provide a direct measurement of sound velocity, wherein the hot-wire sensor is placed at an airflow wind noise source of a vehicle. The hot-wire sensor may be located at outside mirror of the vehicle, a windshield of the vehicle, or a front bumper of the vehicle, to capture structure-borne noise as well as air-borne noise. The accelerometer may be configured to detect vibration of one or more panels of a vehicle, and the noise cancellation system is configured to integrate a measured acceleration signal received from the accelerometer to determine a surface velocity of the one or more panels of a vehicle.

At operation 1006, utilize a virtual microphone algorithm to estimate noise signals at a virtual location based on the noise signals, the estimation utilizing a transfer function that estimates a signal that would have been received by the one or more physical error microphones at the virtual location. Similarly, at operation 1008, utilize the virtual microphone algorithm to estimate noise signals at the virtual location based on the high-frequency noise signal.

At operation 1010, provide a noise-cancelling signal to cancel noise at the virtual location, the noise-cancelling signal accounting for the noise captured by both the feedforward system sensor and the one or more physical error microphones. This signal may be provided, for example, to loudspeakers 112 within the vehicle cabin. As the high-frequency noise signal covers frequencies in a 300 Hz to 1000 Hz frequency band, a working frequency for the ANC may be set to at least 2 kHz. After operation 1010, the process 1000 ends. It should be noted, however, that the process 1000 may be iterative and may repeat in a loop during operation as shown in FIG. 1.

Computing devices described herein generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, JAVA™, C, C++, C#, VISUAL BASIC, JAVA SCRIPT, MATLAB, PERL, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for active noise cancellation (ANC) of high-frequency broadband airborne noise, comprising:

a feedforward system sensor configured to capture a high-frequency noise signal generated in physical proximity to sources of noise for a vehicle;

one or more physical error microphones configured to capture noise signals for cancellation; and an ANC computing device, configured to receive the noise signals from the one or more physical error microphones located at first locations within the vehicle, utilize a virtual microphone algorithm to estimate noise signals at a virtual location based on the noise signals, the estimation utilizing a transfer function that estimates a signal that would have been received by the one or more physical error microphones at the virtual location, receive the high-frequency noise signal from the feedforward system sensor, utilize the virtual microphone algorithm to further estimate noise signals at the virtual location based on the high-frequency noise signal, and provide a noise-cancelling signal to cancel noise at the virtual location, the noise-cancelling signal accounting for the noise captured by both the feedforward system sensor and the one or more physical error microphones, wherein the high-frequency noise signal covers frequencies in a 300 Hz to 1000 Hz frequency band, the one or more physical error microphones lack high frequency information in the 300 Hz to 1000 Hz frequency band for an anti-noise signal to be generated at those frequencies, and a working frequency for the ANC is at least 2 kHz.

2. The system of claim 1, wherein the feedforward system sensor is a microelectrical-mechanical system (MEMS) microphone.

3. The system of claim 2, wherein the MEMS microphone is located inside an outside mirror of a vehicle, to allow the MEMS microphone to capture wind noise of the vehicle.

4. The system of claim 2, wherein the MEMS microphone is located inside a wheel well of a vehicle to perform road noise detection.

5. A system for ANC of high-frequency broadband airborne noise, comprising:

a feedforward system sensor configured to capture a high-frequency noise signal generated in physical proximity to sources of noise for a vehicle;

one or more physical error microphones configured to capture noise signals for cancellation; and an ANC computing device, configured to receive the noise signals from the one or more physical error microphones located at first locations within the vehicle, utilize a virtual microphone algorithm to estimate noise signals at a virtual location based on the noise signals, the estimation utilizing a transfer function that estimates a signal that would have been received by the one or more physical error microphones at the virtual location, receive high-frequency noise signal from the feedforward system sensor, utilize the virtual microphone algorithm to further estimate noise signals at the virtual location based on the high-frequency noise signal, and provide noise-cancelling signal to cancel noise at the virtual location, the noise-cancelling signal accounting for the noise captured by both the feedforward system sensor and the one or more physical error microphones, wherein the feedforward system sensor is a microelectrical-mechanical system (MEMS) microphone located inside an outside mirror of the vehicle, to allow the MEMS microphone to capture wind noise of the vehicle, and the MEMS microphone is coupled to outside air per a submillimeter hole in the outside mirror to minimize self-noise from the MEMS microphone.

6. A system for ANC of high-frequency broadband airborne noise, comprising:

a feedforward sensor configured to capture a high-frequency noise signal generated in physical proximity to sources of noise for a vehicle;

one or more physical error microphones configured to capture noise signals for cancellation; and an ANC computing device, configured to receive the noise signals from the one or more physical error microphones located at first locations within the vehicle, utilize a microphone algorithm to estimate noise signals at a virtual location based on the noise signals, the estimation utilizing a transfer function that estimates a signal that would have been received by the one or more physical error microphones at the virtual location, receive the high-frequency noise signal from the feedforward system sensor, utilize the virtual microphone algorithm to further estimate noise signals at the virtual location based on the high-frequency noise signal, and provide a noise-cancelling signal to cancel noise at the virtual location, the noise-cancelling signal accounting for the noise captured by both the feedforward system sensor and the one or more physical error microphones, wherein the feedforward system sensor is a hot-wire sensor configured to provide a direct measurement of sound velocity, wherein the hot-wire sensor is placed at an airflow wind noise source of a vehicle.

7. The system of claim 6, wherein the hot-wire sensor is located at outside mirror of the vehicle, a windshield of the vehicle, or a front bumper of the vehicle, to capture structure-borne noise as well as air-borne noise.

8. A system for ANC of high frequency broadband airborne noise, comprising:

a feedforward system sensor configured to capture a high-frequency noise signal generated in physical proximity to sources of noise for a vehicle;

one or error microphones configured to capture noise signals for cancellation; and an ANC computing device, configured to receive the noise signals from the one or more physical error microphones located at first locations within the vehicle, utilize a virtual microphone algorithm to estimate noise signals at a virtual location based on the noise signals, the estimation utilizing a transfer function that estimates a signal that would have been received by the one or more physical error microphones at the virtual location, receive the high-frequency noise signal from the feedforward system sensor, utilize the virtual microphone algorithm to further estimate noise signals at the virtual location based on the high-frequency noise signal, and provide a noise-cancelling signal to cancel noise at the virtual location, the noise-cancelling signal accounting for the noise captured by both the feedforward system sensor and the one or more physical error microphones, wherein the feedforward system sensor is an accelerometer configured to detect vibration of one or more panels of a vehicle, and the noise cancellation system is configured to integrate a measured acceleration signal received from the accelerometer to determine a surface velocity of the one or more panels of a vehicle.

9. A method for ANC of high-frequency broadband airborne noise, comprising:

capturing, by a feedforward system sensor, a high-frequency noise signal generated in physical proximity to sources of noise for a vehicle;

capturing, by one or more physical error microphones, noise signals for cancellation;

receiving the noise signals from the one or more physical error microphones located at first locations within the vehicle;

utilizing a virtual microphone algorithm to estimate noise signals at a virtual location based on the noise signals, the estimation utilizing a transfer function that estimates a signal that would have been received by the one or more physical error microphones at the virtual location;

receiving the high-frequency noise signal from the feedforward system sensor;

utilizing the virtual microphone algorithm to further estimate noise signals at the virtual location based on the high-frequency noise signal; and providing a noise-cancelling signal to cancel noise at the virtual location, the noise-cancelling signal accounting for the noise captured by both the feedforward system sensor and the one or more physical error microphones, wherein the high-frequency noise signal covers frequencies in a 300 Hz to 1000 Hz frequency band, the one or more physical error microphones lack high frequency information in the 300 Hz to 1000 Hz frequency band for an anti-noise signal to be generated at those frequencies, and a working frequency for the ANC is at least 2 kHz.

10. The method of claim 9, wherein the feedforward system sensor is a microelectrical-mechanical system (MEMS) microphone.

11. The method of claim 10, wherein the MEMS microphone is located inside an outside mirror of the vehicle, to allow the MEMS microphone to capture wind noise of the vehicle.

12. The method of claim 10, wherein the MEMS microphone is located inside a wheel well of the vehicle to perform road noise detection.

13. A method for ANC of high-frequency broadband airborne noise, comprising:

capturing, by a feedforward system sensor, a high-frequency noise signal generated in physical proximity to sources of noise for a vehicle;

capturing, by one or more physical error microphones, noise signals for cancellation;

receiving the noise signals from the one or more physical error microphones located at first locations within the vehicle;

utilizing a virtual microphone algorithm to estimate noise signals at a virtual location based on the noise signals, the estimation utilizing a transfer function that estimates a signal that would have been received by the one or more physical error microphones at the virtual location;

receiving the high-frequency noise signal from the feedforward system sensor;

utilizing the virtual microphone algorithm to further estimate noise signals at the virtual location based on the high-frequency noise signal; and providing a noise-cancelling signal to cancel noise at the virtual location, the noise-cancelling signal accounting for the noise captured by both the feedforward system sensor and the one or more physical error microphones wherein the feedforward system sensor is a microelectrical-mechanical system (MEMS) microphone located inside an outside mirror of the vehicle, to allow the MEMS microphone to capture wind noise of the vehicle, and the MEMS microphone is coupled to outside air per a submillimeter hole in the outside mirror to minimize self-noise from the MEMS microphone.

14. A method for ANC of high-frequency broadband airborne noise, comprising:

capturing, by a feedforward system sensor, a high-frequency noise signal generated in physical proximity to sources of noise for a vehicle;

capturing, OM or more physical error microphones, noise signals for cancellation;

receiving the noise signals from the one or more physical error microphones located at first locations within the vehicle;

utilizing a virtual microphone algorithm to estimate noise signals at a virtual location based on the noise signals, the estimation utilizing a transfer function that estimates a signal that would have been received by the one or more physical error microphones at the virtual location;

receiving the high-frequency noise signal from the feedforward system sensor;

utilizing the virtual microphone algorithm to further estimate noise signals at the virtual location based on the high-frequency noise signal; and providing a noise-cancelling signal to cancel noise at the virtual location, the noise-cancelling signal accounting for the noise captured by both the system sensor and the one or more physical error microphones, wherein the feedforward system sensor is a hot-wire sensor configured to provide a direct measurement of sound velocity, wherein the hot-wire sensor is placed at an airflow wind noise source of the vehicle.

15. The method of claim 14, wherein the hot-wire sensor is located at outside mirror of the vehicle, a windshield of the vehicle, or a front bumper of the vehicle, to capture structure-borne noise as well as air-borne noise.

16. A method for ANC of high-frequency broadband airborne noise, comprising:

capturing, by feedforward system sensor, a high-frequency noise signal generated in physical proximity to sources of noise for a vehicle;

capturing, by one or more physical error microphones, noise signals for cancellation;

receiving the noise signals from the one or more physical error microphones located at first locations within the vehicle;

utilizing a virtual microphone algorithm to estimate noise signals at a virtual location based on the noise signals, the estimation utilizing a transfer function that estimates a signal that would have been received by the one or more physical error microphones at the virtual location;

receiving the high-frequency noise signal from the feedforward system sensor;

utilizing the virtual microphone algorithm to further estimate noise signals at the virtual location based on the high-frequency noise signal; and providing a noise-cancelling signal to cancel noise at the virtual location, the noise-cancelling signal accounting for the noise captured by both the feedforward system sensor and the one or more physical error microphones, wherein the feedforward system sensor is an accelerometer configured to detect vibration of one or more panels of the vehicle, and further comprising integrating a measured acceleration signal received from the accelerometer to determine a surface velocity of the one or more panels of the vehicle.

17. A non-transitory computer-readable medium comprising instructions that, when executed by one or more processors of an ANC system, cause the ANC system to:

receive noise signals captured from one or more physical error microphones located at first locations within a vehicle, the noise signals lacking high frequency information in the 300 Hz to 1000 Hz frequency band;

receive high-frequency noise signal from a feedforward system sensor, the high-frequency noise signal generated in physical proximity to sources of noise for the vehicle, the high-frequency noise signal covering frequencies in a 300 Hz to 1000 Hz frequency band;

utilize a virtual microphone algorithm to estimate noise signals at a virtual location based on the noise signals, the estimation utilizing a transfer function that estimates a signal that would have been received by the one or more physical error microphones at the virtual location;

utilize the virtual microphone algorithm to further estimate noise signals at the virtual location based on the high-frequency noise signal; and provide a noise-cancelling signal to cancel noise at the virtual location, the noise-cancelling signal accounting for the noise captured by both the feedforward system sensor and the one or more physical error microphones, the ANC system utilizing a working frequency for the ANC of at least 2 kHz.

18. The medium of claim 17, wherein the feedforward system sensor is an accelerometer configured to detect vibration of one or more panels of a vehicle, the medium further comprising instructions that, when executed by the one or more processors of the ANC system, cause the ANC system to integrate a measured acceleration signal received from the accelerometer to determine a surface velocity of the one or more panels of the vehicle.

* * * * *